US007555240B2

(12) United States Patent
Jang

(10) Patent No.: US 7,555,240 B2
(45) Date of Patent: Jun. 30, 2009

(54) COVER MEMBERS FOR AN IMAGE FORMING APPARATUS

(75) Inventor: Jae-young Jang, Suwon-si (KR)

(73) Assignee: Samsung Electronics Co., Inc., Suwon-si, Gyeonggi-do (KR)

( * ) Notice: Subject to any disclaimer, the term of this patent is extended or adjusted under 35 U.S.C. 154(b) by 422 days.

(21) Appl. No.: 11/496,451

(22) Filed: Aug. 1, 2006

(65) Prior Publication Data

US 2007/0092293 A1 Apr. 26, 2007

(30) Foreign Application Priority Data

Oct. 20, 2005 (KR) ..... 10-2005-0099338

(51) Int. Cl.
*G03G 15/00* (2006.01)

(52) U.S. Cl. ..... 399/124

(58) Field of Classification Search ..... 399/107, 399/118, 122, 124, 125; 358/296, 300
See application file for complete search history.

(56) References Cited

U.S. PATENT DOCUMENTS

| | | | | |
|---|---|---|---|---|
| 4,523,831 | A * | 6/1985 | Yokoo et al. | 399/213 |
| 5,337,134 | A * | 8/1994 | Sato et al. | 399/124 |
| 5,897,244 | A * | 4/1999 | Miyazaki et al. | 399/122 |
| 5,950,050 | A * | 9/1999 | Shirasaki et al. | 399/124 |
| 6,384,940 | B1 * | 5/2002 | Kawai et al. | 358/474 |
| 6,571,074 | B2 * | 5/2003 | Suzuki et al. | 399/124 |
| 7,272,338 | B2 * | 9/2007 | Karasawa et al. | 399/107 |
| 7,298,988 | B2 * | 11/2007 | Nakayama | 399/110 |

FOREIGN PATENT DOCUMENTS

| | | |
|---|---|---|
| JP | 08-142445 | 6/1996 |
| KR | 92-20284 | 11/1992 |
| KR | 1020000055981 | 9/2000 |
| KR | 1020010026180 | 4/2001 |
| KR | 1020030070637 | 9/2003 |
| KR | 1020050003876 | 1/2005 |

* cited by examiner

*Primary Examiner*—Robert Beatty
(74) *Attorney, Agent, or Firm*—Roylance, Abrams, Berdo & Goodman, L.L.P.

(57) ABSTRACT

An image forming apparatus is provided that easily allows for removal of paper jams, reduces space for disposing a locking means of a cover, and saves production costs relative to the locking means of a cover. The image forming apparatus forms an image on a printing medium and has a feeding unit, a developing unit, a transfer unit, and an out-feed unit. The image forming apparatus includes a scanning unit that optically reads an image on a paper sheet and creates an electrical image signal. A rear cover is disposed downwardly of the scanning unit and substantially perpendicular to a flat surface of the scanning unit in an opening and closing manner. A top cover is disposed downwardly of the scanning unit and substantially parallel to the scanning unit. The top cover is connected to the rear cover in an opening and closing manner.

19 Claims, 4 Drawing Sheets

COVER MEMBERS FOR AN IMAGE FORMING APPARATUS

CROSS-REFERENCE TO RELATED PATENT APPLICATION

This application claims the benefit under 35 U.S.C. § 119 (a) of Korean Patent Application No. 10-2005-0099338, filed on Oct. 20, 2005, in the Korean Intellectual Property Office, the entire disclosure of which is hereby incorporated by reference.

BACKGROUND OF THE INVENTION

1. Field of the Invention

The present invention relates to an image forming apparatus. More particularly, the present invention relates to an image forming apparatus that allows for easy removal of paper jams, reduces space for disposing a locking means of a cover, and saves production costs relative to the locking means of a cover.

2. Description of the Related Art

Conventional image forming apparatuses include a feeding unit, an exposing unit, a developing unit, a transfer unit, a fixing unit, an out-feed unit, and a cover. Some image forming apparatus, such as a scanner, a copy machine, and a multi-function printer, further include a scanning unit.

The feeding unit feeds a printing medium into an image forming apparatus. The scanning unit optically reads an image of a paper sheet and creates an electrical image signal. The exposing unit forms an electrostatic latent image on the surface of a photoconductor. The developing unit supplies toner as a developing material onto the electrostatic latent image formed on the surface of the photoconductor and develops the electrostatic latent image into a toner image.

The fixing unit, which includes a heat roller and a pressure roller, melts and fuses the toner image onto the printing medium passing through the fixing unit by applying high heat and pressure on the printing medium that has the toner image attached thereon. Because high heat and pressure are applied onto the fixing unit to fuse the toner image onto the printing medium, the printing medium becomes flexible. For this and other reasons, the printing medium often clings to and becomes entangled with the heat roller when the printing medium is fed out through a fixing nip. Therefore, a printing jam, such as an accordion jam, or an accordion effect, may occur.

The out-feed unit includes an out-feed roller and feeds the printing medium out of the image forming apparatus after an image has been fixed on the printing medium.

The cover, which covers a main frame of the image forming apparatus to protect the image forming apparatus from external stress and to beautify the outlook, includes a top cover, a fixing unit cover, and a rear cover.

In a conventional top cover, a rear end portion of the image forming apparatus has been connected with the main frame in a rotating manner, and an upper end portion thereof has been connected with the main frame in an opening and closing manner. However, in an image forming apparatus having a scanning unit, the scanning unit has normally been disposed over the top cover separated by a predetermined distance. The entire top cover has been covered by the scanning unit, and the fixing unit on which a paper jam mainly occurs has been disposed under a rear side of the top cover. Furthermore, to open the upper end portion of the top cover to remove a printing medium caught near the fixing unit, a user has to reach his or her hand downward of the scanning unit. Therefore, it has been very difficult to remove the jammed printing medium.

Additionally, when the paper jam occurs, the rear cover has been opened first and the top cover and the fixing unit cover have sequentially been opened to remove the paper jam. In this case, as in the case of the top cover, the rear cover has been connected with the main frame in an opening and closing manner using a separate member, and the fixing unit cover has been connected with the fixing unit in an opening and closing manner using a separate member.

Accordingly, because a locking means for opening and closing the covers has been provided as a separate member, the number of parts and the number of manufacturing processes have increased, and therefore production costs have increased as a whole.

Accordingly, a need exists for an image forming apparatus having improved covers to facilitate clearing paper jams in the image forming apparatus.

SUMMARY OF THE INVENTION

Exemplary embodiments of the present invention provide an image forming apparatus that allows for easy removal of paper jams.

Exemplary embodiments of the present invention also provides an image forming apparatus that reduces space for disposing a locking means and saves production costs relative to disposing the locking means by improving a structure of the locking means of each cover.

According to an aspect of the present invention, an image forming apparatus forms an image on a printing medium and has a feeding unit, a developing unit, a transfer unit, and an out-feed unit. The image forming apparatus comprises a scanning unit that optically reads an image on a paper sheet and creates an electrical image signal. A rear cover is disposed downwardly of the scanning unit and is substantially perpendicular to a flat surface of the scanning unit in an opening and closing manner. A top cover is disposed downwardly of the scanning unit and is substantially parallel to the scanning unit, and is connected with the rear cover in an opening and closing manner.

The top cover may be structured such that the upper end portion of the rear cover is pulled down first and the end portion of the top cover near the rear cover is then raised upwardly to an open position.

The rear cover may include a hook at the upper end portion thereof.

The side end surface of the rear cover may be L-shaped, and the hook may be formed at one end portion of the L-shape.

The side end surface of the hook may be hook-shaped.

The top cover may comprise a guide rib that is disposed substantially perpendicular to the flat surface of the top cover. A snag having a shape corresponding to the hook of the rear cover is formed at the lower end portion of the guide rib. The hook of the rear cover is connected with the snag.

A fixing unit that melts a toner image and fixes the toner image onto the printing medium may be further included downwardly of the top cover.

A fixing unit cover for substantially preventing heat generated by the fixing unit from being transmitted to the outside may be further included at the bottom surface of the top cover.

The fixing unit cover may be opened upwardly along with the top cover when the top cover is opened upwardly.

Other objects, advantages and salient features of the invention will become apparent from the following detailed description, which, taken in conjunction with the annexed drawings, discloses exemplary embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

Hereinafter, exemplary embodiments of the present invention are described in detail with reference to the accompanying drawings.

Figure 1:
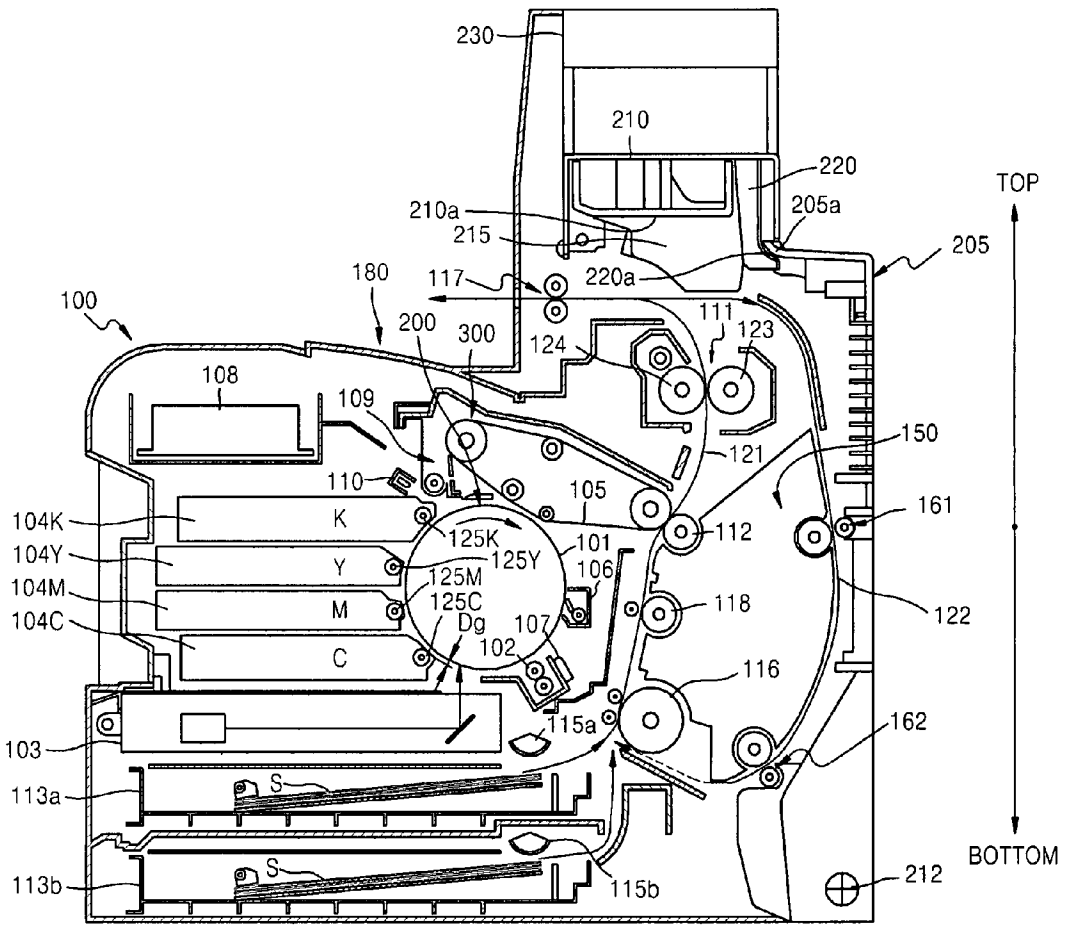
FIG. 1 is a schematic elevational view in cross section of an image forming apparatus according to an exemplary embodiment of the present invention.
Figure 2:
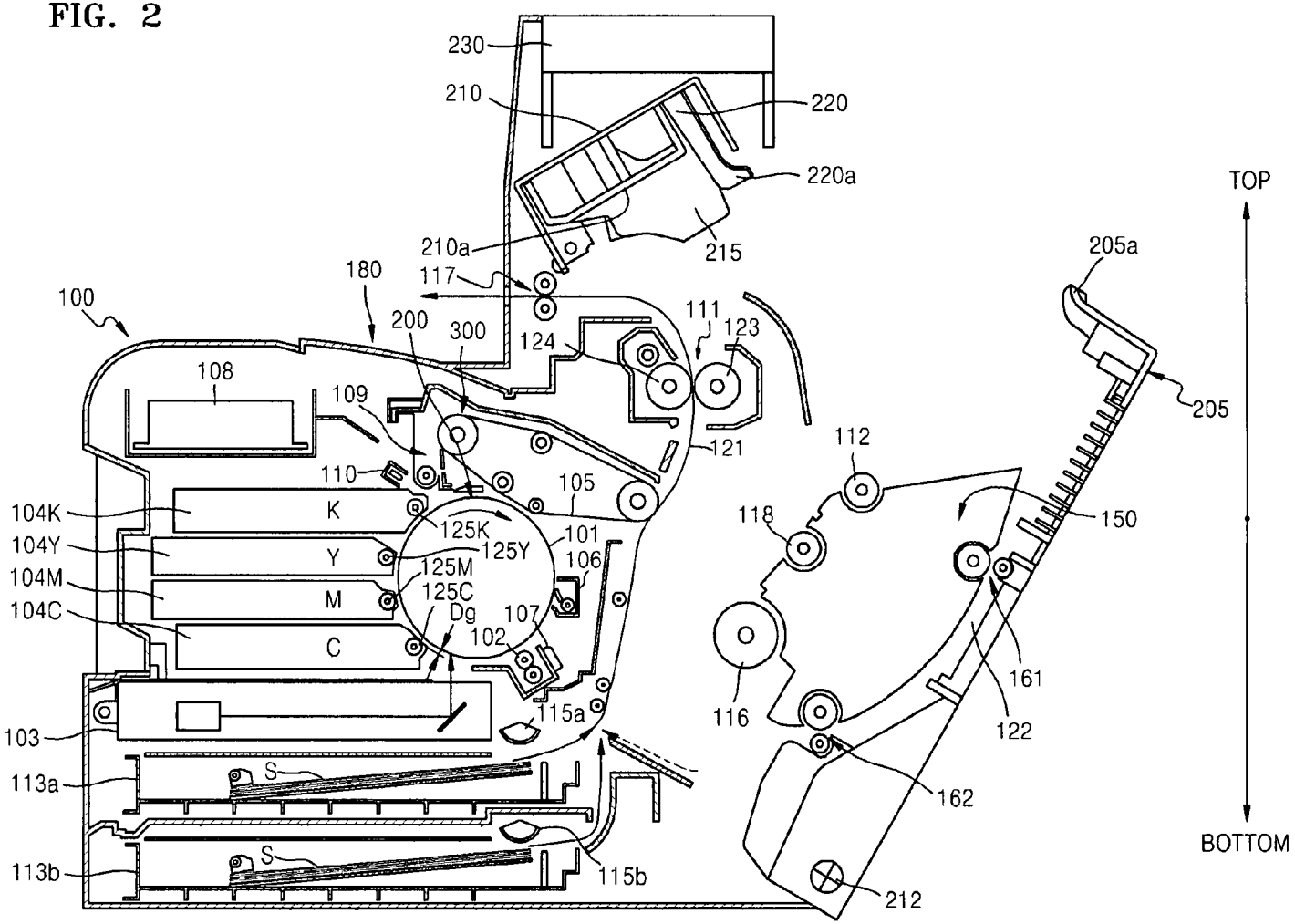
FIG. 2 is an elevational view in cross section of an image forming apparatus of FIG. 1 when a rear cover and a top cover are in an opened position.
Figure 3:
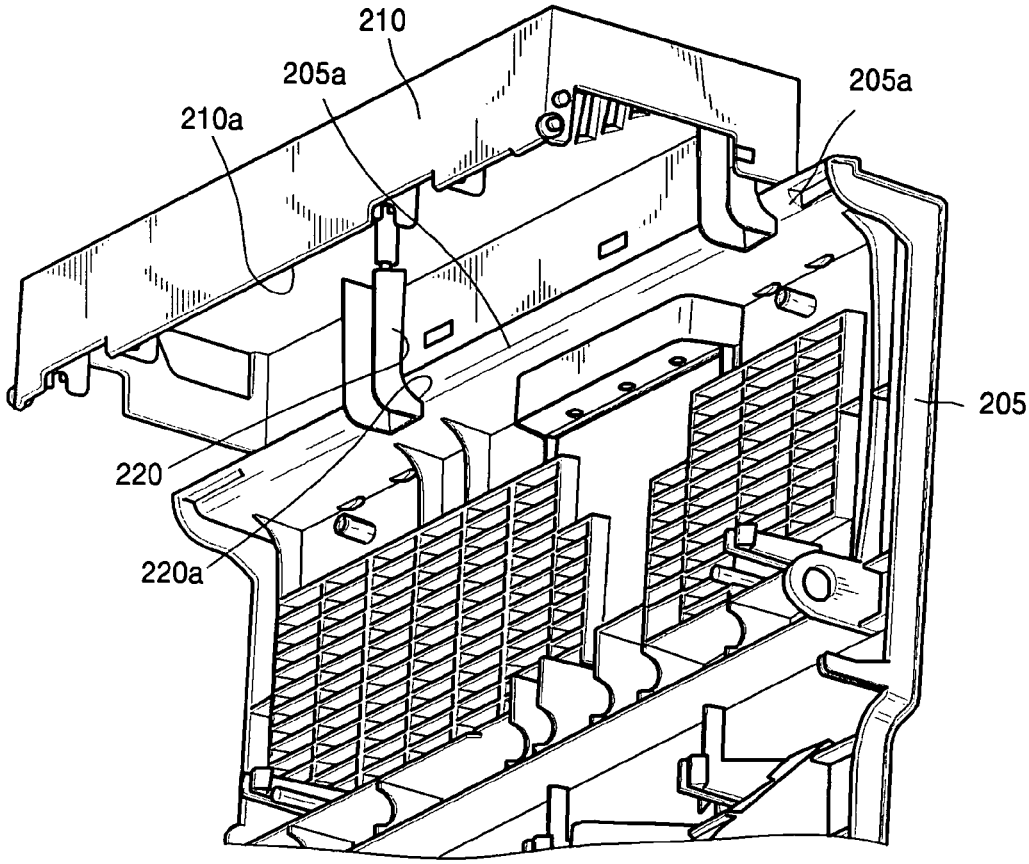
FIG. 3 is a partial perspective view of a structure combining a rear cover and a top cover of FIG. 1.
Figure 4:
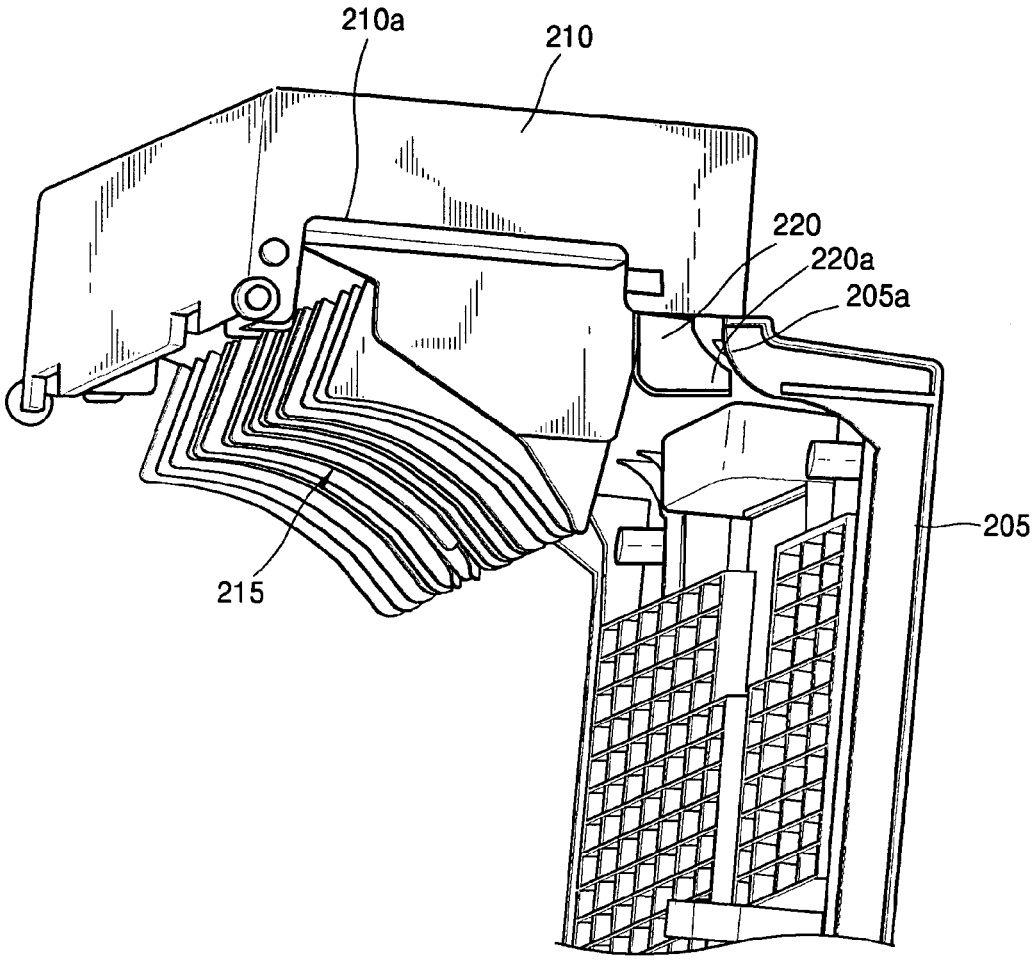
FIG. 4 is a partial perspective view of a structure of FIG. 3 to which a fixing unit cover is additionally combined.

FIG. 1 is a schematic elevational view in cross section of an image forming apparatus according to an exemplary embodiment of the present invention. FIG. 2 is an elevational view in cross section of an image forming apparatus of FIG. 1 when a rear cover and a top cover are in an opened position. FIG. 3 is a partial perspective view of a structure combining a rear cover and a top cover of FIG. 1. FIG. 4 is a partial perspective view of a structure of FIG. 3 to which a fixing unit cover is additionally combined.

Referring to the drawings, an image forming apparatus according to an exemplary embodiment of the present invention includes a photoconductor 101, a charging roller 102, a light scanning unit 103, four developing units 104C, 104M, 104Y, and 104K, a transfer belt 105, a fixing unit 111, a scanning unit 230, a rear cover 205, a duplex unit 150, and a top cover 210.

A rotating body, the photoconductor 101, in which a photoconductive layer is coated on the outer circumferential surface of a cylindrical metal drum by deposition, is disposed such that a portion of the outer circumferential surface thereof is exposed. An electrostatic latent image corresponding to a desired image is formed on the outer circumferential surface of the photoconductor 101 by the after-mentioned light scanning unit 103.

A charging roller 102 is an example of a charger that equipotentially charges the photoconductor 101. The charging roller 102 rotates in contact or non-contact with the outer circumferential surface of the photoconductor 101 and supplies an electric charge thereto so that the outer circumferential surface of the photoconductor 101 has a uniform electric potential. A charging bias voltage is applied to the charging roller 102 to equipotentially charge the outer circumferential surface of the photoconductor 101. A corona discharger (not shown) may be used instead of the charging roller 102.

The light scanning unit 103 is disposed downwardly of the photoconductor 101 and forms the electrostatic latent image on the outer circumferential surface of the photoconductor 101 by illuminating light corresponding to image data onto the equipotentially charged photoconductor 101 in response to an electrical signal. The light scanning unit 103 includes a light source (not shown) that illuminates a laser beam and a beam deflector that deflects the laser beam illuminated by the light source. The beam deflector may be a well known deflector, such as a polygonal mirror (not shown) or a hologram disc (not shown). A laser scanning unit (LSU) that normally uses a laser diode as a light source is used as the light scanning unit 103.

The four developing units 104C, 104M, 104Y, and 104K are types of cartridges that are disposed in a main frame of the image forming apparatus in a detachable manner. Solid powder toners of cyan C, magenta M, yellow Y, and black K are respectively stored therein. The four developing units 104C, 104M, 104Y, and 104K respectively include developing rollers 125K, 125Y, 125M, and 125C that supply toners onto the electrostatic latent image formed on the photoconductor 101 to form a toner image.

The developing rollers 125K, 125Y, 125M, and 125C attach the toners stored in the developing units onto the outer circumferential surface thereof and supply the toners to the photoconductor 101. The developing rollers 125K, 125Y, 125M, and 125C store the solid powder type toners and develop the toner image by supplying the toners onto the electrostatic latent image formed on the photoconductor 101. A developing bias voltage for supplying the toners onto the photoconductor 101 is applied to the developing rollers 125K, 125Y, 125M, and 125C.

The four developing units 104C, 104M, 104Y, and 104K are disposed such that developing rollers 125K, 125Y, 125M, and 125C are separated from the outer circumferential surface of the photoconductor 101 by a predetermined distance, or a development gap Dg. A force directing from the photoconductor 101 to the developing rollers 125K, 125Y, 125M, and 125C is generated by an electric field, and charged toners are reciprocally vibrated in a development area formed in the development gap Dg and are transferred to be developed. The toner images of cyan C, magenta M, yellow Y, and black K that are sequentially formed on the photoconductor 101 are sequentially transferred onto the transfer belt 105. The toner images are superimposedly transferred onto the transfer belt 105 and thereby a color toner image is formed. Generally, the length of the transfer belt 105 has to be equal or greater than the length of a printing medium S on which the color toner image is finally transferred.

A transfer roller 112 faces a surface where the toner image is transferred onto the transfer belt 105, and a transfer bias voltage having an opposite polarity with respect to the toner image is applied thereto so that the toner image transferred onto the transfer belt 105 may be transferred onto the printing medium S. The toner image is transferred onto the printing medium S by an electrostatic force acting between the photoconductor 101 and the transfer belt 105. While the color toner image is being transferred onto the transfer belt 105, the transfer roller 112 is separated from the transfer belt 105, and when the color toner image is completely transferred onto the transfer belt 105, the transfer roller 112 comes in contact with the transfer belt 105 by a predetermined pressure to transfer the color toner image onto the printing medium S. Additionally, the toner image transferred onto the outer circumferential surface of the transfer belt 105 may be transferred onto the printing medium S passing through between the transfer roller 112 and the transfer belt 105 by a contact pressure between the transfer roller 112 and the transfer belt 105.

A first cleaning unit 106 removes a waste toner remaining on the outer circumferential surface of the photoconductor 101 after the toner image is transferred onto the transfer belt 105. Additionally, a second cleaning unit 109 removes waste toner remaining on the transfer belt 105 after the toner image is transferred onto the printing medium S.

Before transferring the toner image on the photoconductor 101 to the transfer belt 105, a pre-transfer charge removing unit 110 removes an electric charge in a portion (non-image portion) except where the toner image on the photoconductor 101 is formed and improves the efficiency of transferring from the photoconductor 101 to the transfer belt 105.

The charge removing lamp 107 is a specific example of a charge eliminating means that removes an electric charge remaining on the outer circumferential surface of the photoconductor 101 prior to a charging operation. The charge removing lamp 107 removes the electric charge remaining on the outer circumferential surface of the photoconductor 101 by illuminating a constant amount of light onto the outer circumferential surface of the photoconductor 101.

A power supply 108 provides a developing bias voltage for developing toner from the developing unit 104 to the photoconductor 101, an anti-developing bias voltage for preventing the toner from being attached from the developing unit 104 to the photoconductor 101, a first transfer bias voltage for transferring the toner from the photoconductor 101 to the transfer belt 105, a second transfer bias voltage for transferring the toner image from the transfer belt 105 to the printing medium S, and a charging bias voltage provided to the charging roller 102.

A fixing unit 111 includes a heat roller 123 and a pressure roller 124 facing thereto and fixes the toner image onto the printing medium S by applying heat and pressure. The heat roller 123 is a heat source for permanently fixing the toner image and faces the pressure roller with respect to an axial direction thereof. The pressure roller 124 facing the heat roller 123 fixes the toner image onto the printing medium S by applying high pressure.

The scanning unit 230 optically reads an image on a paper sheet and creates an electrical image signal.

An out-feed unit 117 feeds the printing medium S out of the image forming apparatus after an image has been fixed to the printing medium. The printing medium S fed out of the image forming apparatus is loaded on an out-feed tray 180.

The image forming apparatus includes a feeding cassette 113*a* that is disposed at the lower side of the main frame and loads the printing medium S thereon. The feeding cassette 113*a* is an example of a loading means for loading the printing medium S thereon. The loading means may additionally include a second feeding cassette 113*b* for loading the printing medium S thereon.

Pick-up rollers 115*a* and 115*b* feed out the printing medium S loaded on the feeding cassettes 113*a* and 113*b* sheet by sheet.

A feeding unit 116 provides a feeding force that feeds the printing medium S fed out from the feeding cassettes 113*a* and 113*b* by the pick-up rollers 115*a* and 115*b* towards an arranging roller 118.

The arranging roller 118 arranges the upper end portion of the printing medium S before the printing medium S passes through between the transfer belt 105 and the transfer roller 112, so that the toner image may be transferred onto a desired portion of the printing medium S. The printing medium S arranged by the arranging roller 118 passes through the fixing unit 111 after passing through between the transfer belt 105 and the transfer roller 112 and is fed out of the image forming apparatus by an out-feed unit 117. The arranging roller 118 is disposed proximal duplex unit 150.

A paper feeding path that guides the printing medium S between the feeding unit 116 and the fixing unit 111 is referred to as a feeding path 121. When duplex printing, a roller of the out-feed unit 117 reversely rotates, and the printing medium S is fed along a reverse path 122. Then, the printing medium S is flipped so that an image may be printed on a surface where images have not yet been printed. The flipped printing medium S is again fed along with the feeding path 121 by the feeding unit 116, and the image is printed on the surface where the image has not yet been printed.

A rear cover 205 is disposed at the rear side of the image forming apparatus in a rotating manner by a hinge 212 provided at one side thereof. More specifically, the rear cover 205 is disposed downwardly of the scanning unit 230 and substantially perpendicular to a flat surface of the scanning unit 230. Disposing the rear cover 205 substantially perpendicularly to the flat surface of the scanning unit 230 means that the rear cover 205 is substantially perpendicular to the flat surface of the scanning unit 230, or it appears to be substantially perpendicular as a whole although not perfectly perpendicular.

Additionally, when the printing medium S is jammed during printing, the rear cover 205 is open and closed to remove the jammed printing medium. The rear cover 205 includes a hook 205*a* at the upper end portion thereof for opening and closing. The side end surface of the rear cover 205 is substantially L-shaped, and the hook 205*a* is formed at one end portion of the L-shape, as shown in FIG. 3. Preferably, the side end surface of the hook 205*a* is hook-shaped. However, the present invention is not limited thereto, and the rear cover 205 and the hook 205*a* included therein may be disposed at various positions and have various forms.

The duplex unit 150, in which the reverse path 122 is formed between the rear cover 205 and the duplex unit 150, and the feeding path 121 is formed at the opposite side of the reverse path 122, is separated from the rear cover 205 facing thereto. First and second conveying rollers 161 and 162 are disposed between the duplex unit 150 and the rear cover 205 to feed the printing medium S to the reverse path 122.

The top cover 210 is disposed at the upper end portion of the main frame 100. More specifically, the top cover 210 is disposed between the scanning unit 230 and the fixing unit 111 as viewed in the height direction of the image forming apparatus. Additionally, the top cover 210 is disposed substantially parallel to the flat surface of the scanning unit 230. Disposing the top cover 210 substantially parallel to the flat surface of the scanning unit 230 means that the top cover 210 is substantially parallel to the flat surface of the scanning unit 230, or it appears substantially parallel as a whole although not perfectly parallel. Corresponding portions of one end and the other end of the top cover 210 are rotatably connected with the main frame 100, and an opposite end of the top cover 210 with respect to a rotation axis of the top cover for the main frame 100 is connected with the rear cover 205 by suitable means, such as a hook. More specifically, the top cover 210 includes a guide rib 220 at the bottom 210*a* thereof. Here, the guide rib 220 is disposed substantially perpendicular to the flat surface of the top cover 210, and a snag 220*a* having a shape corresponding to the hook 205*a* of the rear cover 205 is disposed on the lower end portion of the guide rib 220. Additionally, the hook 205*a* of the rear cover 205 is connected with the snag 220*a* of the guide rib 220.

Accordingly, compared with a conventional image forming apparatus having a locking means that respectively combines the rear cover 205 and the top cover 210 with the main frame 100 in an opening and closing manner by using additional members, in an image forming apparatus according to the exemplary embodiments of the present invention, a space for disposing the locking means and the number of parts relative to disposing the locking means and the number of manufacturing processes is remarkably reduced, so that productions cost may be saved as a whole. Namely, in the image forming apparatus according to the exemplary embodiments of the present invention, the hook 205*a* and the snag 220*a* may be respectively included in manufacturing processes of the rear cover 205 and the top cover 210 to be incorporated with the rear cover 205 and the top cover 210.

To open the top cover 210, the upper end portion of the rear cover 205 is pulled down first. At this time, the hook 205*a* of the rear cover 205 moves over the snag 220*a* of the guide rib 220 and is thereby separated from the snag 220*a*. Next, the end portion of the top cover 210 near the rear cover 205, that is, the rear side end portion of the top cover 210 is raised upwardly to be opened. Namely, unlike as in the prior art in which the front side of the image forming apparatus has been opened, the exemplary embodiments of the present invention provide the top cover 210, so that the rear side of the image forming apparatus may be opened, the printing medium S jammed near the fixing unit 111 may be seen when the top cover 210 is opened, and the printing medium S may be easily reached. Therefore, in a structure in which the scanning unit 230 is placed upwardly of the top cover 210, the printing medium S may be also easily reached simply by opening the top cover 210, so a paper jam may be easily removed.

Additionally, a fixing unit cover 215 is disposed at the bottom 210*a* of the top cover 210, as shown in FIG. 4. The fixing unit cover 215 substantially prevents heat generated by the fixing unit 111 from being transmitted to the outside. Namely, the fixing unit cover 215 prevents a user from a burn or discomfort when the heat generated by the fixing unit 111 is transmitted to the top cover 210 or the rear cover 205 and the user touches the covers 205 and 210.

Accordingly, when the paper jam occurs, the rear cover 205 is opened first, the top cover 210 is then opened upwardly, and the fixing unit cover 215 is then opened upwardly along with the top cover 210. When the fixing unit cover 215 is opened upwardly, the printing medium S jammed near the fixing unit 111 is exposed to the outside.

Hereinafter, operations of the image forming apparatus according to the exemplary embodiments of the present invention are described.

More than two data corresponding to cyan C, magenta M, yellow Y, and black K are combined in color image data. In the exemplary embodiments of the present invention, toner images of the respective colors are superimposed onto the transfer belt 105 in the order of cyan C, magenta M, yellow Y, and black K and are then transferred onto the printing medium S, thereby forming a color image.

The outer circumferential surface of the photoconductor 101 is equipotentially charged by the charging roller 102. When a light signal corresponding to cyan C image data is illuminated onto the rotating photoconductor 101 by the light scanning unit 103, the resistance of a light illuminated portion is reduced and an electric charge attached on the outer circumferential surface of the photoconductor 101 is separated therefrom. As a result, an electric potential difference occurs between the light illuminated portion and the other portion, and an electrostatic latent image is thereby formed on the outer circumferential surface of the photoconductor 101.

When the photoconductor 101 rotates and the electrostatic latent image approaches the cyan developing unit 104C, the developing roller 125C of the cyan developing unit 104C starts to rotate. A development bias voltage is applied from the power supply 108 to the developing roller 125C of the cyan developing unit 104C. Additionally, an anti-developing bias voltage for preventing development is applied to the developing rollers 125M, 125Y, and 125K of other developing units 104M, 104Y, and 104K. Then, only the cyan C toner passes across the development gap Dg and is attached on the electrostatic latent image formed on the outer circumferential surface of the photoconductor 101, thereby forming a cyan C toner image.

The printing medium S is fed out from the feeding cassettes 113*a* and 113*b* by the pick-up rollers 115*a* and 115*b*, arranged by the arranging roller 118, fed through the paper feeding paths 121 and 122, and fed out of the image forming apparatus by the out-feed unit 117.

When the photoconductor 101 rotates and the cyan C toner image approaches the transfer belt 105, the toner image is transferred onto the transfer belt 105 by the first transfer bias voltage or contact pressure between the photoconductor 101 and the transfer belt 105.

After the cyan C toner image is completely transferred onto the transfer belt 105, toner images of magenta M, yellow Y, and black K are subjected to the above mentioned operations and are superimposedly transferred onto the transfer belt 105.

During the above-mentioned operations, the transfer roller 112 is separated from the transfer belt 105. When all of the four toner images are superimposedly transferred onto the transfer belt 105 and a color toner image is formed on the transfer belt 105, the transfer roller 112 contacts the transfer belt 105 to transfer the color toner image onto the printing medium S.

By the time a front end of the color toner image formed on the transfer belt 105 reaches a point where the transfer belt 105 and the transfer roller 112 are in contact with each other, the printing medium S is supplied from the feeding cassettes 113*a* and 113*b*, so that the front end of the printing medium S reaches the point where the transfer belt 105 and the transfer roller 112 are in contact with each other. When printing medium S passes through between the transfer belt 105 and the transfer roller 112, the color toner image is transferred onto the printing medium S by the second transfer bias voltage, fixed onto the printing medium S in the fixing unit 111 by applying heat and pressure, and then loaded out, thereby completing the formation of a color image.

For the next printing, the first and second cleaning units 106 and 109 remove waste toner remaining on the photoconductor 101 and the transfer belt 105, and the charge removing lamp 107 removes a charge remaining on the photoconductor 101 by illuminating light onto the photoconductor 101.

Accordingly, the exemplary embodiments of the present invention provide an image forming apparatus in which a paper jam is easily removed by changing an opened and closed position of a top cover.

Additionally, the exemplary embodiments of the present invention also provide an image forming apparatus that reduces space for disposing a locking means and saves production costs relative to disposing the locking means by improving a structure of the locking means of each cover.

While the present invention has been particularly shown and described with reference to exemplary embodiments thereof, it will be understood by those skilled in the art that various changes in form and details may be made therein without departing from the spirit and scope of the present invention as defined by the appended claims.

What is claimed is:

1. An image forming apparatus that forms an image on a printing medium and has a feeding unit, a developing unit, a transfer unit, and an out-feed unit, the image forming apparatus comprising:

a scanning unit that optically reads an image on a paper sheet and creates an electrical image signal;

a rear cover disposed downwardly of the scanning unit, the rear cover being movable between opened and closed positions to open and close a side portion of the image forming apparatus; and a top cover disposed downwardly of the scanning unit and movable between opened and closed positions to open and close a top portion of the image forming apparatus, the rear and top covers being connected when the rear and top covers are in the closed positions.

2. The apparatus according to claim 1, wherein an upper end portion of the rear cover is pulled down first and an end portion of the top cover proximal the rear cover is then raised upwardly to open the top cover.

3. The apparatus according to claim 1, wherein the rear cover comprises a hook at an upper end portion thereof.

4. The apparatus according to claim 3, wherein a side end surface of the rear cover is substantially L-shaped.

5. The apparatus according to claim 4, wherein the hook is formed at one end portion of the substantially L-shaped side end surface.

6. The apparatus according to claim 5, wherein the side end surface of the hook is hook-shaped.

7. The apparatus according to claim 1, wherein the top cover comprises a guide rib, a snag having a shape substantially corresponding to the hook of the rear cover and formed at a lower end portion of the guide rib, and the hook of the rear cover is detachably connected to the snag.

8. The apparatus according to claim 1, wherein a fixing unit that melts a toner image and fixes the toner image onto the printing medium is disposed downwardly of the top cover.

9. The apparatus according to claim 8, wherein a fixing unit cover for substantially preventing heat generated by the fixing unit from being transmitted to the outside is disposed at a bottom surface of the top cover.

10. The apparatus according to claim 9, wherein the fixing unit cover is opened upwardly along with the top cover when the top cover is opened upwardly.

11. An image forming apparatus, comprising:

a scanning unit disposed in the image forming apparatus;

a fixing unit disposed in the image forming apparatus downwardly of the scanning unit;

a rear cover disposed downwardly of the scanning unit, the rear cover being movable between opened and closed positions to open and close a side portion of the image forming apparatus; and a top cover disposed downwardly of the scanning unit, the top cover being movable between opened and closed positions to open and close a top portion of the image forming apparatus, such that the fixing unit is accessible when the rear and top covers are in the opened positions, the rear and top covers being connected when the rear and top covers are in the closed positions.

12. The apparatus according to claim 11, wherein the top cover is locked to the rear cover when the rear and top covers are in the closed positions.

13. The apparatus according to claim 12, wherein the rear cover has a hook at an upper end portion thereof to lock the top cover.

14. The apparatus according to claim 13, wherein the top cover has a guide rib, a snag having a shape substantially corresponding to the hook of the rear cover and formed at a lower end portion of the guide rib, and the hook of the rear cover is detachably connected to the snag.

15. The apparatus according to claim 11, wherein a side end surface of the rear cover is substantially L-shaped.

16. The apparatus according to claim 11, wherein a fixing unit cover for substantially preventing heat generated by the fixing unit from being transmitted to the outside is disposed at a bottom surface of the top cover.

17. The apparatus according to claim 16, wherein the fixing unit cover is opened upwardly along with the top cover when the top cover is opened upwardly.

18. A method of accessing a fixing unit of an image forming apparatus; comprising the steps of opening a rear cover disposed downwardly of the scanning unit to open a side portion of the image forming apparatus; and opening a top cover disposed downwardly of the scanning unit such that the fixing unit disposed in the image forming apparatus is accessible when the rear and top covers are in the opened positions, the top cover being connected to the rear cover when the rear and top covers are in closed positions.

19. The method according to claim 18, further comprising opening the rear cover before opening the top cover to access the fixing unit.

* * * * *